US006305929B1

(12) United States Patent
Chung et al.

(10) Patent No.: US 6,305,929 B1
(45) Date of Patent: Oct. 23, 2001

(54) LASER-INDUCED IGNITION SYSTEM USING A CAVITY

(75) Inventors: Suk Ho Chung, School of Mechanical and Aerospace Engineering, Seoul National University, Seoul 151-742 (KR); Mohamed Hassan Morsy, Suez (EG); Young Sung Ko, Seoul (KR)

(73) Assignees: Suk Ho Chung; School of Mechanical and Aerospace Engineering, Seoul National University, both of Seoul (KR)

( * ) Notice: Subject to any disclaimer, the term of this patent is extended or adjusted under 35 U.S.C. 154(b) by 0 days.

(21) Appl. No.: 09/316,950

(22) Filed: May 24, 1999

(51) Int. Cl.[7] ..... F23Q 7/10; F02P 23/04

(52) U.S. Cl. ..... 431/254; 431/258; 123/143 B; 60/39.821

(58) Field of Search ..... 123/143 B, 143 R; 431/254, 258, 259, 11; 376/103, 101; 219/121.6; 60/39.821; 392/419

(56) References Cited

U.S. PATENT DOCUMENTS

| | | | | |
|---|---|---|---|---|
| 3,378,446 | * | 4/1968 | Whittlesey | 376/103 |
| 3,427,118 | * | 2/1969 | Andress et al. | 431/258 |
| 3,473,879 | * | 10/1969 | Berberich | 123/143 B |
| 3,489,645 | * | 1/1970 | Daiber et al. | 376/103 |
| 4,142,088 | * | 2/1979 | Hirsch | 376/103 |
| 4,302,933 | * | 12/1981 | Smith | 431/263 |
| 4,314,530 | * | 2/1982 | Giacchetti | 123/143 R |
| 4,416,226 | * | 11/1983 | Nishida et al. | 123/143 B |
| 4,434,753 | * | 3/1984 | Mukainakano et al. | 123/143 B |
| 4,947,640 | * | 8/1990 | Few et al. | 431/258 |
| 5,221,820 | * | 6/1993 | Shimoji | 431/258 |
| 5,413,478 | * | 5/1995 | Lang | 431/265 |
| 5,756,924 | * | 5/1998 | Early | 123/143 B |
| 5,769,621 | * | 6/1998 | Early et al. | 431/258 |
| 5,876,195 | * | 3/1999 | Early | 123/143 B |

FOREIGN PATENT DOCUMENTS

08165978-A * 6/1996 (JP) .

* cited by examiner

*Primary Examiner*—Ira S. Lazarus
*Assistant Examiner*—Josiah C. Cocks
(74) *Attorney, Agent, or Firm*—Long Aldridge & Norman LLP

(57) ABSTRACT

An apparatus which can confine almost entire available energy in the vicinity of ignition point during a laser-induced ignition process is proposed. Multiple reflection by a cavity surface when a small diameter laser beam is directed into the cavity is utilized in laser ignition. Shadowgraphs of the early stages of the combustion process for quiescent methane/air mixtures show that a hot gas jet emerges from the cavity. During subsequent flame propagation, both similarities with and difference from conventional spark ignition processes are observed, depending on the cavity size and the concentration of mixtures. With laser cavity ignition, the chamber pressure increases relatively rapidly and higher maximum pressure can be achieved. As a result, the combustion duration for laser cavity ignition is decreased relative to laser-induced spark ignition.

4 Claims, 6 Drawing Sheets

LASER-INDUCED IGNITION SYSTEM USING A CAVITY

BACKGROUND OF THE INVENTION

The present invention relates to an ignition system, and more particularly to a laser-induced ignition system with a cavity.

It is desirable to burn lean mixtures in spark ignition engines to improve both fuel economy and emission characteristics. When mixtures which are lean or diluted with exhaust gases are used, the ignition system has a critical influence on misfire or cycle-to-cycle variation. Similarly, ignition is an important design factor in gas turbines, rocket combustors, and the like.

Various ignition systems including high energy spark plugs, plasma jet ignitors, rail plug ignitors, laser-induced ignition, flame jet ignitors, torch jet ignitors, pulsed-jet combustion, and exhaust gas recirculation ignition systems have been proposed. Among these, an ignition system using an energy source from a laser is utilized.

A laser-induced spark ignition system focuses a laser beam to generate a gaseous breakdown and sufficient laser energy can ignite a fuel/oxidizer premixture. This system has many potential advantages, even though some limitations still exist. For example, a laser-induced spark is a reasonable point energy source in which the amount of energy, the rate of its deposition, and ignition timing can be controlled. It also permits choice of the optimal ignition location, which is not easy in conventional ignition systems. In addition, the absence of a material surface in the vicinity of ignition location minimizes the effect of heat loss during flame kernel development.

There are four basic mechanisms, depending on the mode of energy deposition, by which a laser can produce an ignition kernel; thermal heating, resonant and nonresonant breakdown, and photo-dissociation. The relative importance of each mechanism depends on the wavelength of the laser beam. Nonresonant breakdown is the most frequently adopted ignition mode and is generally termed laser-induced spark ignition.

One of the disadvantages of laser-induced spark ignition is that only a portion of laser energy is absorbed by gaseous medium in the vicinity of the ignition location. The rest of the laser energy, for example ranging from 30 to 70%, is lost since the unabsorbed laser beam passes through the ignition location, so that it cannot be utilized in the ignition process.

SUMMARY OF THE INVENTION

In order to overcome the above problem, the present invention provides an ignition system in which almost entire incident laser energy can be confined near an ignition location.

A preferred embodiment of the invention provides an ignition system including a combustion chamber having a cavity, and having a mixed gas for combustion; a source means for producing laser energy; and optic means for directing the laser energy into said cavity in the combustion chamber.

Experimental results on laser-induced ignition using a cavity are presented.

Other elements, features, advantages and components of preferred embodiments of the present invention will be described in further detail with reference to the drawings attached hereto.

BRIEF DESCRIPTION OF THE DRAWINGS

The accompanying drawings, which are incorporated in and constitute a part of the specification, illustrate preferred embodiments of the present invention, and together with the description, serve to explain the principles of the present invention.

PREFERRED EMBODIMENTS OF THE INVENTION

The preferred embodiment of the present invention will be explained with reference to the accompanying drawings.

Figure 1A:
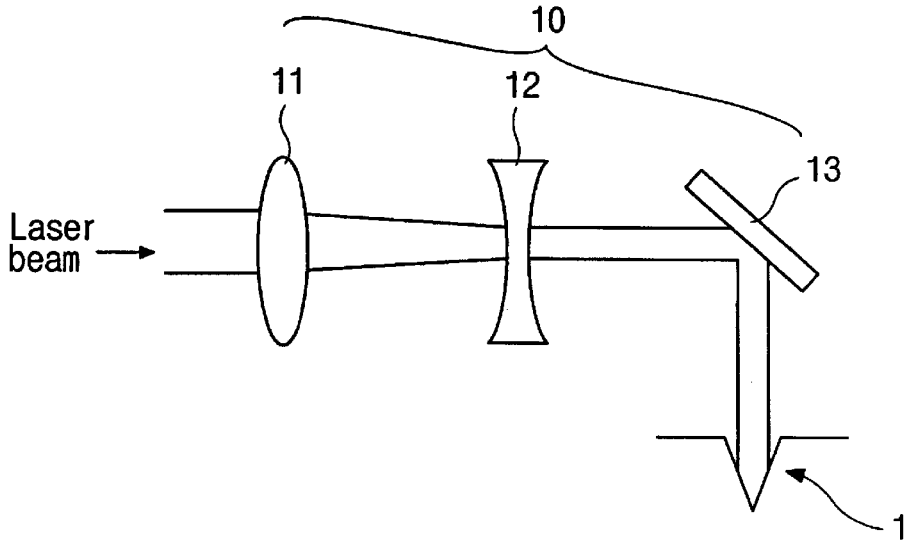
FIG. 1A is a schematic view showing laser-induced ignition system using a conical cavity according to the present invention.

FIG. 1A shows the principle of the multiple refection and beam trapping in a cavity 1 which has a conical shape. Laser energy is directed into the conical cavity 1 via optical means 10.

The optical means includes a convex lens 11, a concave lens 12 and mirror 13, which are necessary only when changing direction and size of laser beam diameter, thus if a proper laser source for this kind of laser induced ignition is developed, it is not necessary.

Figure 1B:
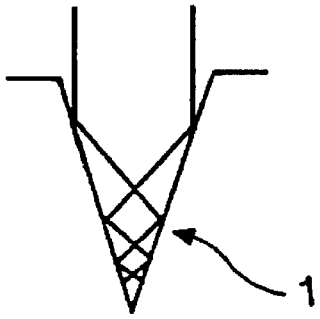
FIG. 1B is a schematic view showing the principle of multiple reflection inside cavity.
Figure 1C:
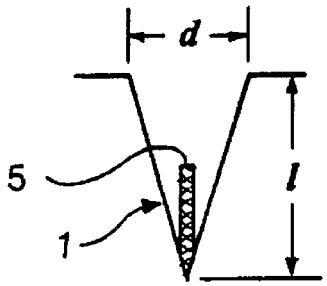
FIG. 1C shows a model of breakdown channel in the conical cavity.

The principle is that part of the incident laser energy is absorbed on the surface of a cavity and the rest of the energy is reflected. The reflected laser beam is directed toward the apex of a cavity and multiple reflections on the cavity surface effectively trap almost all the incident energy within the cavity as shown in FIG. 1B. Reflection of the incident laser beam from the axisymmetric surface of a conical cavity has a beam focusing effect along the center axis of the cavity. FIG. 1C shows a cylindrical shaped breakdown channel 5 in the conical cavity 1 as a result of multiple reflections. If the conical surface has a high reflectivity, the focusing effect will be more pronounced.

Figure 1D:
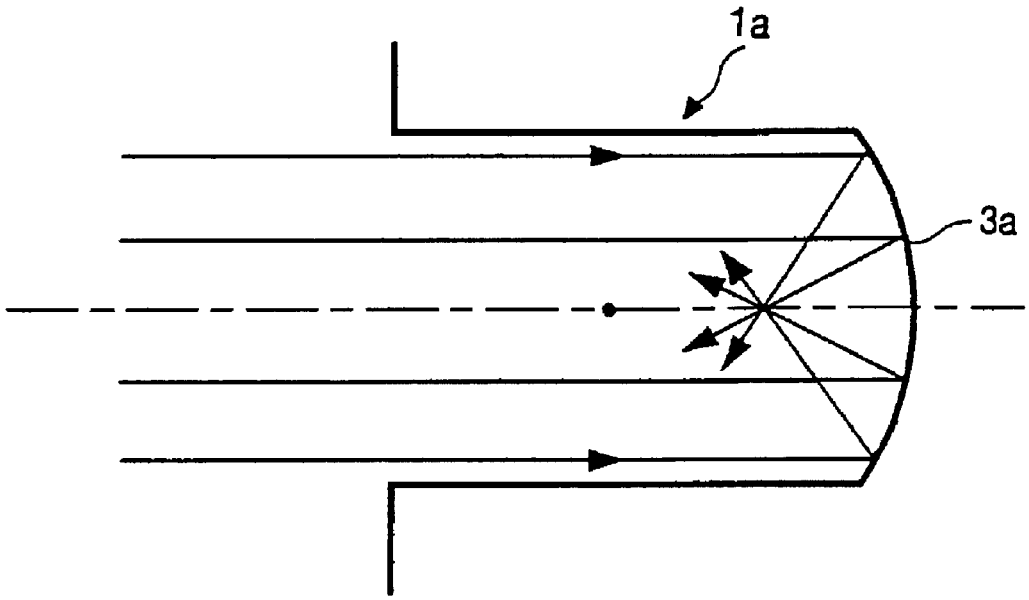
FIG. 1D shows a cavity having a spherical shaped wall.
Figure 1E:
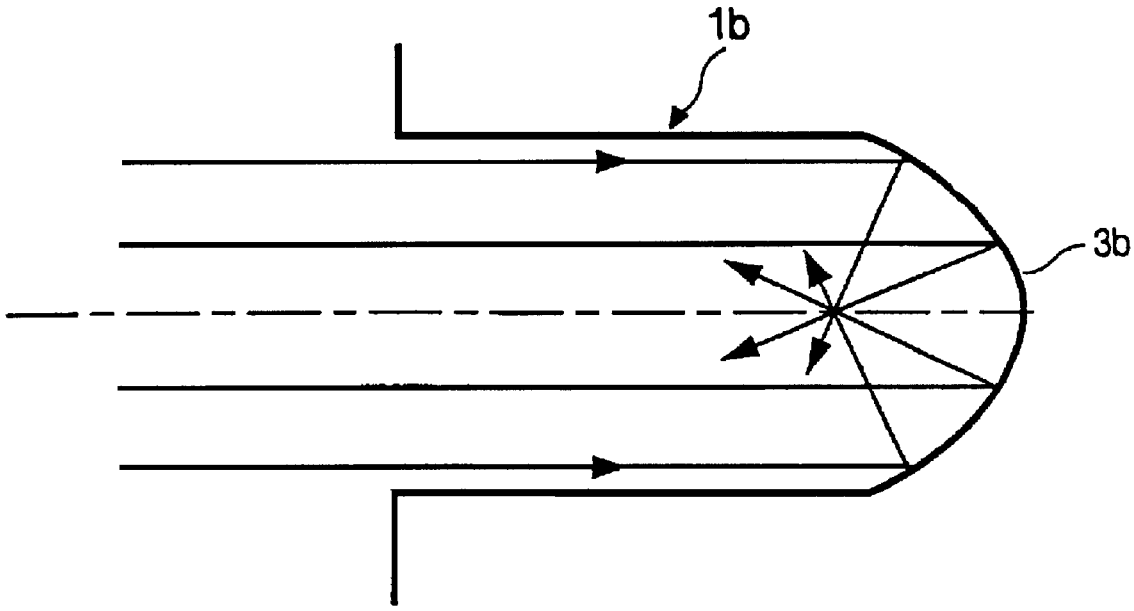
FIG. 1E shows a cavity having a parabolic shaped wall.

FIGS. 1D and 1E shows a cavity 1*a* for a combustion chamber having a spherical shaped inner wall 3*a* and a cavity 1*b* for a combustion chamber having a parabolic shaped inner wall 3*b*, respectively. Reflected laser beam on either spherical or parabolic surfaces 3*a* and 3*b* effectively focuses the beam to their respective focal point, thus inducing gaseous breakdown in the vicinity of focal point.

The incident energy eventually dissipates inside the cavity 1, part of it heats up the gaseous medium in the cavity 1 and the rest heats the cavity surface material. A highly heated reacting gas formed within the cavity 1 will be ejected in the form of a jet. This jet could have similar effect as that in plasma jet ignition. Plasma jet ignition needs very high energy, of the order of several joules, while the energy needed for the present laser-induced cavity ignition can be much lower, although the corresponding jet intensity can be weaker.

In the following, it will demonstrated that laser-induced ignition with a conical cavity can be a viable ignition technique which can be applied to various combustion systems. Experimental results are presented to elucidate the basic understanding of the mechanism in laser-induced cavity ignition.

Experiment

Figure 2:
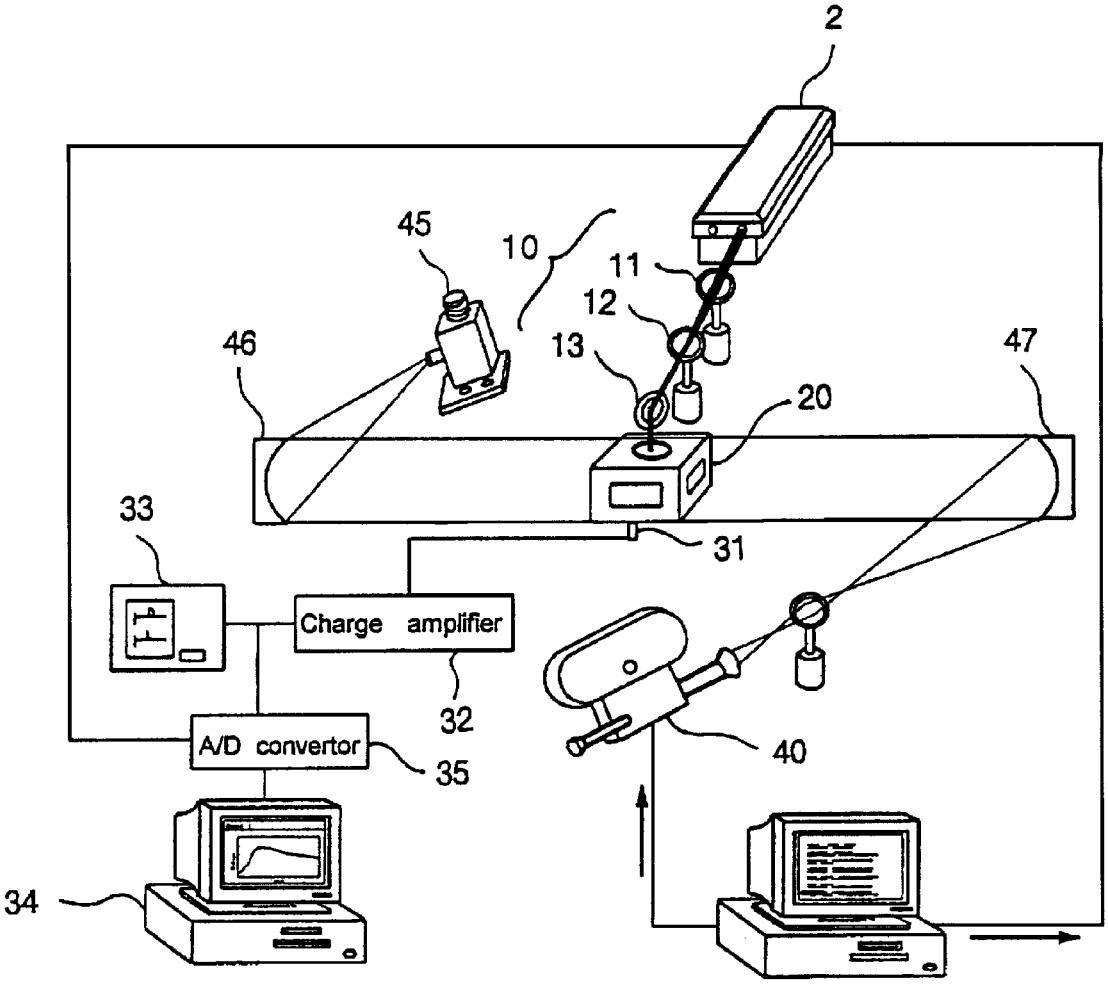
FIG. 2 is a schematic view showing experimental setup for laser-induced cavity ignition experiment.

The apparatus includes a laser source 2, an optical means 10, a combustion chamber 20 which has a conical cavity on the bottom surface, as schematically shown in FIG. 2. The combustion chamber 20 for this experiment is a hexahedron with dimensions 60 mm×60 mm×20 mm. It has three windows (BK-7) with anti-reflection coatings. The upper window admits the laser beam for the cavity ignition test, while the other two, located on opposite sides, serve as the entrance and exit for a laser-induced spark ignition test. The chamber also has two quartz windows for flow visualization by shadowgraphy.

Chemically pure grade methane is premixed with air in a mixing chamber where the equivalence ratio of mixture is determined based on partial pressures. The mixture is then introduced into the combustion chamber 20. Two equivalence ratios of $\phi$=1.0 and 0.7 are tested.

A Q-switched Nd;YAG laser 2 (Spectra Physics, GCR-150) at 532 nm is used as an ignition source to produce a single pulse of about 7 ns duration. The initial beam diameter is 7 mm with 360 mJ maximum available energy per pulse. In the laser-induced spark ignition experiment, laser energy is measured by a dual beam arrangement (not shown) in which two beam splitters located in the front and at the back of the combustion chamber, reflect a small percentage of incident and transmitted laser beams onto respective detectors (Molectron, J25-152). Incident and transmitted pulse energies are measured with laser energy joulemeters (Molectron, EM 500), which in turn are calibrated with a thermopile energy meter (Scientech, MC 2501). Energy losses due to lenses and windows are taken into account, while other losses, such as radiance and light scattered by the gas breakdown induced plasma are neglected.

Two conical cavities, schematically shown in FIG. 1C, are tested. Cavity I has dimensions of d=2.5 mm inlet diameter and l=3.5 mm depth. Cavity II has d=1.6 mm and l=2.0 mm. In Cavity I experiment, the diameter of the laser beam is reduced to 1.8 mm using a combination of a f200 mm convex lens 11 and a f50 mm concave lens 12. For Cavity II test, the laser beam diameter is reduced to 1.4 mm using a f250 mm convex lens 11 to direct all the laser beam into the cavity.

The minimum incident energy needed to ignite a mixture successfully, meaning that the ignition probability becomes nearly 100%, depends on both the cavity size and the equivalence ratio of mixture. For Cavity I, the minimum incident energy is 60 mJ and 90 mJ for $\phi$=0.7, respectively, while it is decreased significantly for Cavity II, to 20 mJ and 35 mJ, respectively. Although it is expected that the minimum incident energy can be further decreased by reducing the laser beam diameter, a smaller beam diameter has not been tested to prevent damaging the windows. In this experiment, incident laser energies of 80 mJ and 110 mJ are used to ignite the mixtures of $\phi$=1.0 and 0.7, respectively, for Cavity I. Similarly, 40 mJ and 55 mJ are used for Cavity II.

The transmittance losses in the optical components are measured and found to be approximately 6.9% per lens and 2.6% per window. From the measured incident laser energy and optical losses, the energy directed into the cavity can be calculated. In this experiment, results are presented in terms of incident laser energy.

Pressure in the chamber is measured by a piezoelectric pressure transducer 31 (Kistler, 6051) connected to a charge amplifier 32 (Kistler, 5011), a digital oscilloscope 33, and a personal computer 34 with an A/D board 35 (Analogic, Fast 12-1). The measured pressure is the average for three tests, from which flame initiation period, combustion duration, and total combustion time are determined. The flame initiation period is defined as the time from ignition to 5% of mass burned; the total combustion time as the time to 90% mass burned; and the combustion duration as the time for 5% to 90% mass burned.

Either a high speed camera 40 (Hitachi, 16 HM; max. 10000 fps) or a high speed video camera 40 (Kodak Ektapro) at 4000 fps, synchronized with laser, is used to visualize flame behavior.

For shadowgraphs, Xenon lamp 45 and two concave mirrors 46 and 47 are used.

Results

Figure 3:
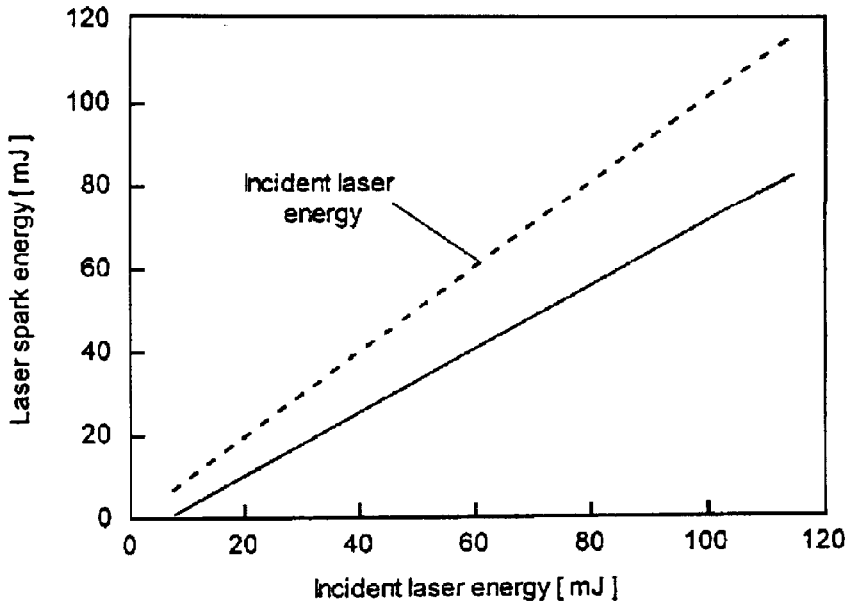
FIG. 3 is a graph illustrating laser spark energy as a function of incident laser energy in laser-induced spark ignition.

The experimental results are summarized as follows. First, to emphasize the merit of utilizing almost entire available incident energy for ignition near the ignition location, energy absorption during laser-induced spark ignition is first tested. Measured laser-induced spark energy as a function of incident laser energy is shown in FIG. 3, where the rest of the incident energy is lost during the ignition process. There are losses due to optical components; however, a significant portion of the incident energy just passes through the focal volume, and thus can not be utilized during ignition process. Over the range investigated, the spark energy, $E_s$, increases linearly with the incident laser energy, $E_l$, and can be fitted by:

$$E_s=0.75478E_l-4.7694\ [mJ] \tag{8}$$

The results show that 30%~70% of the incident laser energy can be utilized in laser-induced spark ignition for 10 mJ<$E_l$<115 mJ.

Figure 4A:
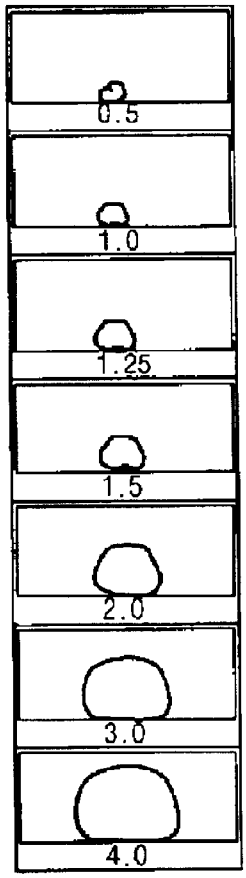
FIGS. 4A and 4B are shadowgraphs for early stages of combustion process using cavity I with $P_i$=1.5 atm for $\phi$=1.0 and $\phi$=0.7, respectively.
Figure 4B:
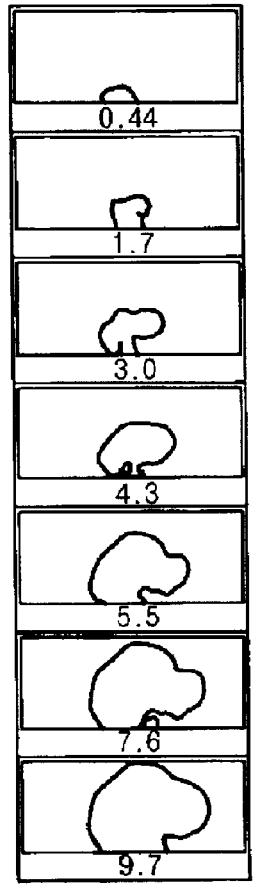

Ignition and subsequent combustion characteristics are visualized for the proposed method of confining the incident laser energy to the vicinity of ignition location with conical cavities. Series of shadowgraphs of the combustion processes with Cavity I for $\phi$=1.0 and $\phi$=0.7 are shown in FIGS. 4A and 4B, respectively, where numbers indicate time [ms] after laser shot. For $\phi$=1.0, the initial jet at time t=0.5 ms from laser shot is slightly detached from the inlet of the cavity. Subsequent burning, however, proceeds very close to the inlet of the cavity. As time proceeds, at about t=2.0 ms, the lower part of the flame touches the bottom surface of the combustion chamber. The overall features of flame propagation are quite similar to typical flame propagation initiated by a conventional spark plug. Subsequently, the flame has a somewhat hemispherical shape, spreading out along the chamber surface.

For =0.7, the penetration of the initial hot jet, e.g. at $\phi$=3.0 ms, becomes more pronounced than is the case for $\phi$=1.0. This can be attributed to the higher temperature and pressure developed inside the cavity by the higher laser energy (110 mJ) compared to the stoichiometric mixture (80 mJ). The hot gas jet penetrates an appreciable distance into the combustion chamber, even though the head velocity is relatively slow. After a short period of time for kernel development, the flame propagates with its geometric center located near the center of the combustion chamber. The flame surface is somewhat wrinkled compared to the case with $\phi$=1.0. This can be attributed to two factors: one is the stronger intensity of the initial jet and the other is diffusional-thermal instability, since the effective Lewis number for the lean methane/air mixture is less than unity.

Figure 5A:
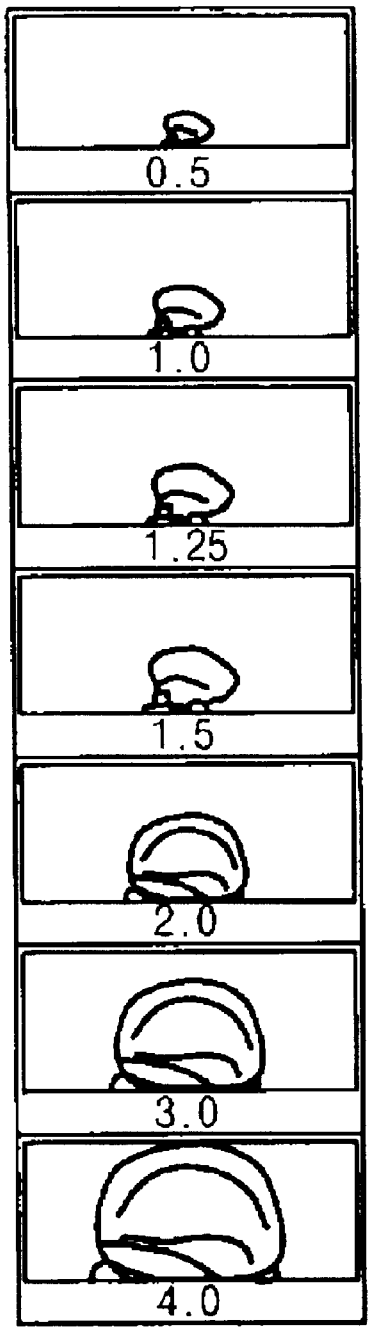
FIGS. 5A and 5B are shadowgraphs for early stages of combustion process using cavity II with $P_i$=1.5 atm for $\phi$=1.0 and $\phi$=0.7, respectively.
Figure 5B:
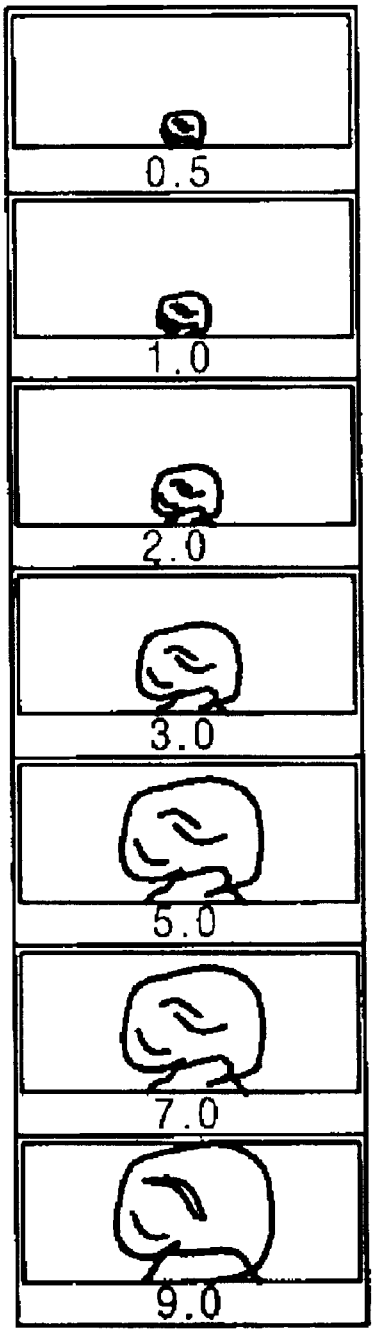

Shadowgraphs for the flame propagation with Cavity II for $\phi$=1.0 and 0.7 are presented in FIGS. 5A and 5B, where numbers indicate time [ms] after laser shot. It can be seen that the flame with Cavity II propagates somewhat differently from that with cavity I. It appears that initially there is a jet ejected from the cavity into the chamber. Then, a second flame seems to be initiated at the cavity inlet after some delay time (t=1.0 ms and 5.0 ms for $\phi$=1.0 and 0.7, respectively).

The secondary flame initiation may be caused by the laser energy absorption on the cavity surface. When an intense pulsed laser beam irradiates a metal surface, a laser-supported combustion wave can be initiated. Since the beam diameter is small, the intensity of the laser energy absorbed on the surface can be high enough to initiate and support combustion.

When burning lean mixtures using Cavity II (FIG. 5B), there is a fast expulsion of a gaseous jet toward the center of the chamber and the kernel is projected into the mixture at an appreciable distance away from the cavity.

Figure 6:
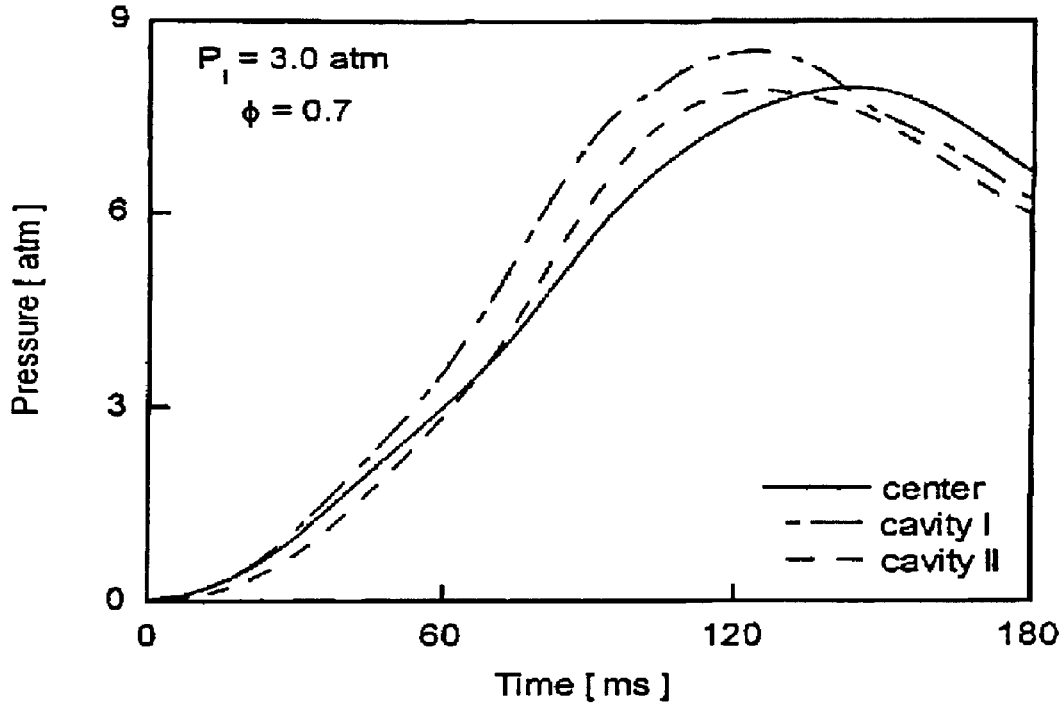
FIG. 6 is a graph illustrating pressure histories comparing laser-induced spark ignition (center) and cavity ignition.

FIG. 6 shows typical pressure traces comparing cavity ignition and center ignition. Here, the "center ignition" implies that the laser beam is focused at the center of the hexahedral chamber and the flame is initiated by nonresonant thermal breakdown of gas, resulting in a laser-induced spark. The pressure traces with cavity ignition exhibit rapid pressure rise, especially with Cavity I, as compared to the center ignition.

Figure 7:
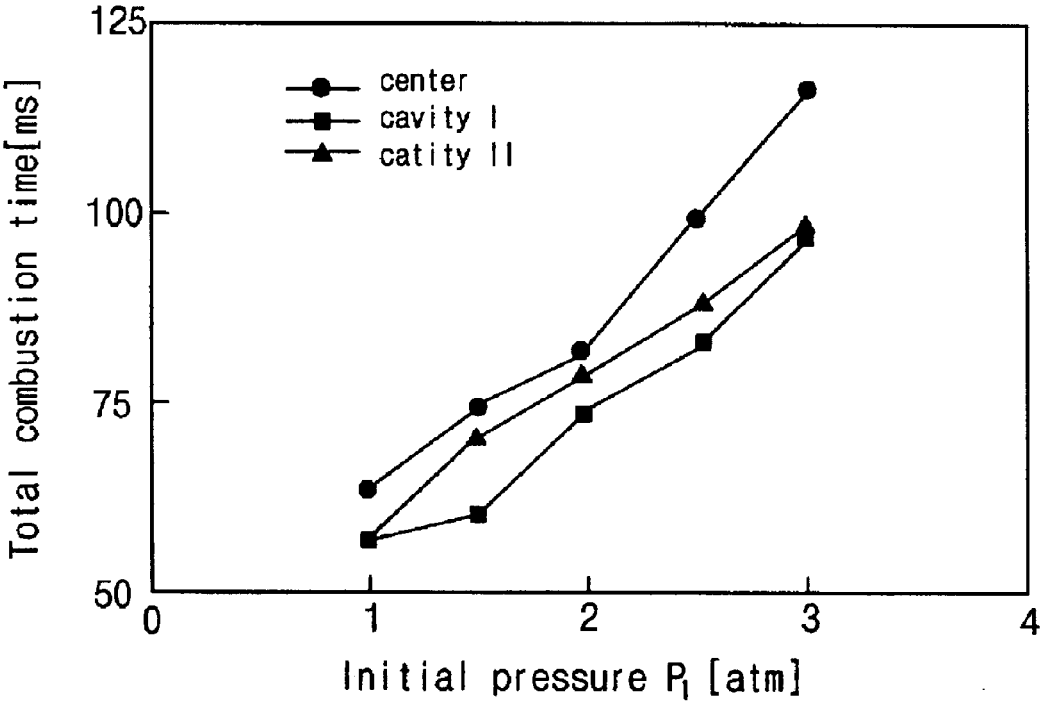
FIG. 7 is a graph illustrating total combustion time comparing laser-induced spark ignition (center) and cavity ignition at various initial pressures for $\phi$=0.7.

The higher rate of combustion obtained using cavity ignition is also demonstrated in FIG. 7, in which the total combustion time for the three different cases at various initial pressures for $\phi$=0.7 are compared. This shows that cavity ignition reduces combustion time. The reduction in combustion time can be attributed to the ejection of a hot gaseous jet into the central region of the combustion chamber, resulting in an overall convective motion. The comparison between shadowgraphs for center ignition (although not shown) and cavity ignition substantiates these features of cavity ignition. The flame volume at the same elapsed times after ignition is smaller and the flame front is smoother for center ignition, as compared to cavity ignition.

A method of confining available incident laser energy in the vicinity of ignition location by adopting a cavity has been proposed. This laser-induced cavity ignition has been demonstrated for methane/air mixtures using shadowgraphy and pressure measurement.

The main findings can be summarized as follows:

1. It is possible to ignite combustible mixtures without focusing the laser beam, but instead, by reducing its diameter and then directing it into a small conical cavity.

2. Shadowgraphs of the early stages of combustion process show that a hot gas jet is ejected from the cavity, especially during the combustion of lean mixture and that the jet penetrates into the combustion chamber.

3. Cavity ignition exhibits a faster and higher maximum pressure rise, with decreased total combustion time, compared to the center ignition by a laser-induced spark, especially when burning a lean mixture.

4. Between the two cavities tested, smaller cavity requires less energy for ignition.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A laser induced ignition system, comprising:

a laser device for producing a plurality of laser beams, at least two of said plurality of laser beams being parallel;

a combustion chamber containing a fuel mixture, the chamber having a cavity defined therein, a window and at least one inner wall forming a cavity;

an optic means for directing the laser beams onto the inner wall of the chamber through the window;

wherein each of the parallel laser beams directed onto said inner wall reflect off of said inner wall multiple times to form a linear breakdown channel in the fuel mixture within said chamber to produce a high speed jet by igniting the fuel mixture.

2. The system of claim 1, wherein the inner surface of the cavity has a conical shape.

3. The system of claim 1, wherein the optic means includes a convex lens and concave lens apart from each other.

4. The system according to claim 3, wherein the optic means further includes a mirror for directing the laser beams from the convex lens and the concave lens to the inner wall of the combustion chamber.

* * * * *

UNITED STATES PATENT AND TRADEMARK OFFICE

CERTIFICATE OF CORRECTION

PATENT NO. : 6,305,929 B1
DATED : October 23, 2001
INVENTOR(S) : Suk-Ho Chung et al.

It is certified that error appears in the above-identified patent and that said Letters Patent is hereby corrected as shown below:

Title page,
Item [73], Assignee, change to: -- Suk Ho Chung of Seoul Korea (KR) --

Signed and Sealed this

Seventh Day of September, 2004

JON W. DUDAS
*Director of the United States Patent and Trademark Office*